United States Patent [19]

Szetela

[11] B 3,981,675

[45] Sept. 21, 1976

[54] CERAMIC BURNER CONSTRUCTION

[75] Inventor: Eugene J. Szetela, South Windsor, Conn.

[73] Assignee: United Technologies Corporation, Hartford, Conn.

[22] Filed: Dec. 19, 1974

[21] Appl. No.: 534,313

[44] Published under the second Trial Voluntary Protest Program on January 27, 1976 as document No. B 534,313.

[52] U.S. Cl. ..... 431/175; 60/39.65; 431/351

[51] Int. Cl.[2] ..... F23C 5/28

[58] Field of Search ..... 431/174, 175, 176, 180, 431/328, 351; 60/39.37, 39.65

[56] References Cited

UNITED STATES PATENTS

| | | | |
|---|---|---|---|
| 2,060,993 | 11/1936 | Keith | 431/180 |
| 2,777,291 | 1/1957 | Darling | 60/39.65 |
| 3,247,884 | 4/1966 | McFadden et al. | 431/351 |
| 3,425,675 | 2/1969 | Twine | 431/328 |
| 3,671,171 | 6/1972 | Doyle | 60/39.65 |
| 3,856,455 | 12/1974 | Otway et al. | 431/351 |

*Primary Examiner*—Kenneth W. Sprague
*Attorney, Agent, or Firm*—Charles A. Warren

[57] ABSTRACT

A burner construction especially for gas turbine engines in which the combustion takes place in a plurality of small porous ceramic burner cans that are mounted on a flame tube and extend substantially at right angles to the tube with fuel nozzles at the end remote from the flame tube.

12 Claims, 4 Drawing Figures

FIG. 2
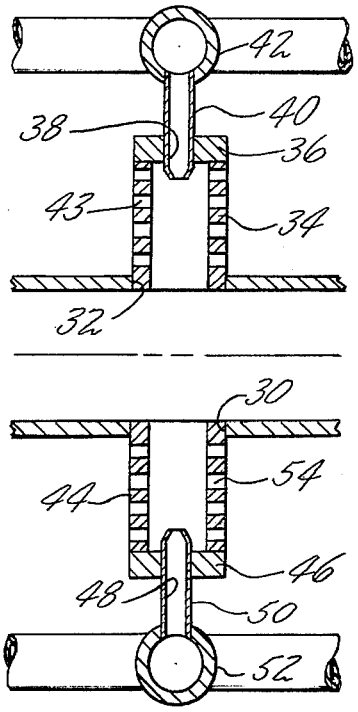
FIG. 3
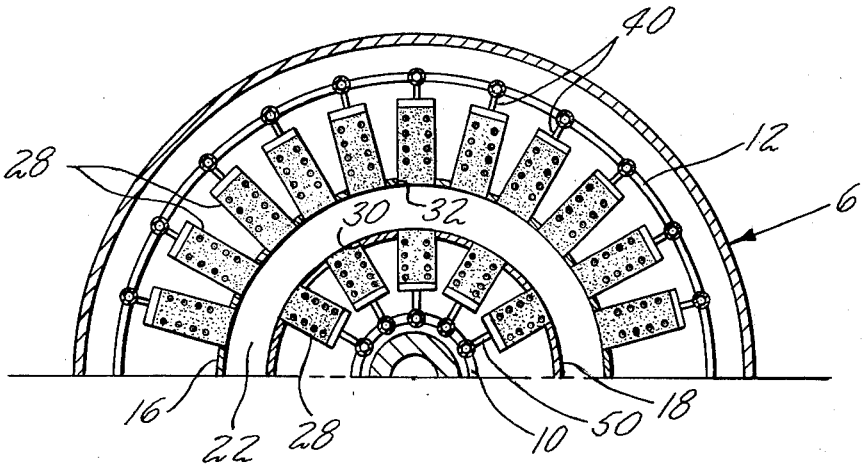
FIG. 4

CERAMIC BURNER CONSTRUCTION

SUMMARY OF THE INVENTION

Ceramics present an interesting concept for use in burner constructions, especially in high performance gas turbine engines since they are much more heat resistant than the best known usable metals or alloys. However, ceramics are weak in tension and the substitution of ceramic walls for metallic walls in conventional burners is impossible because of the tensile stresses created during operation. For example, in a can type burner, the non-uniform combustion causes distortions that induce local tensile stresses in the burner can with resultant failure. In annular burners, the inner flame tube wall is inevitably under tension, and the outer wall is subject to local tensile stresses.

The present invention involves a construction that minimizes the development of tensile stresses by utilizing a plurality of small size ceramic burner cans that will be operating under compression, and being small, the stresses that may develop will be smaller. Further, by making the ceramic walls porous overheating may be prevented and excessive thermal stresses minimized by transpiration cooling.

According to the invention, the combustion chamber wall has a flame tube spaced radially therefrom and the flame tube carries a plurality of small ceramic burner cans, extending substantially at right angles to the flame tube and located between the wall and the flame tube. The end of each burner can remote from the flame tube has a fuel nozzle mounted therein, and the flame tube has openings to the edges of which the ends of the burner cans are attached. These cans are preferably a ceramic fiber material that is porous and rows of openings in the wall of the can admit air for combustion into the cans. The plurality of cans will provide for the same quantity of fuel consumption and for the necessary complete combustion as the conventional burner construction.

The foregoing and other objects, features, and advantages of the present invention will become more apparent in the light of the following detailed description of preferred embodiments thereof as illustrated in the accompanying drawing.

BRIEF DESCRIPTION OF THE DRAWING

FIG. 2 is a sectional view of one individual outer burner can.

FIG. 3 is a sectional view of one individual inner burner can.

FIG. 4 is a transverse sectional view along the line 4—4 of FIG. 1.

DESCRIPTION OF THE PREFERRED EMBODIMENT

Figure 1:
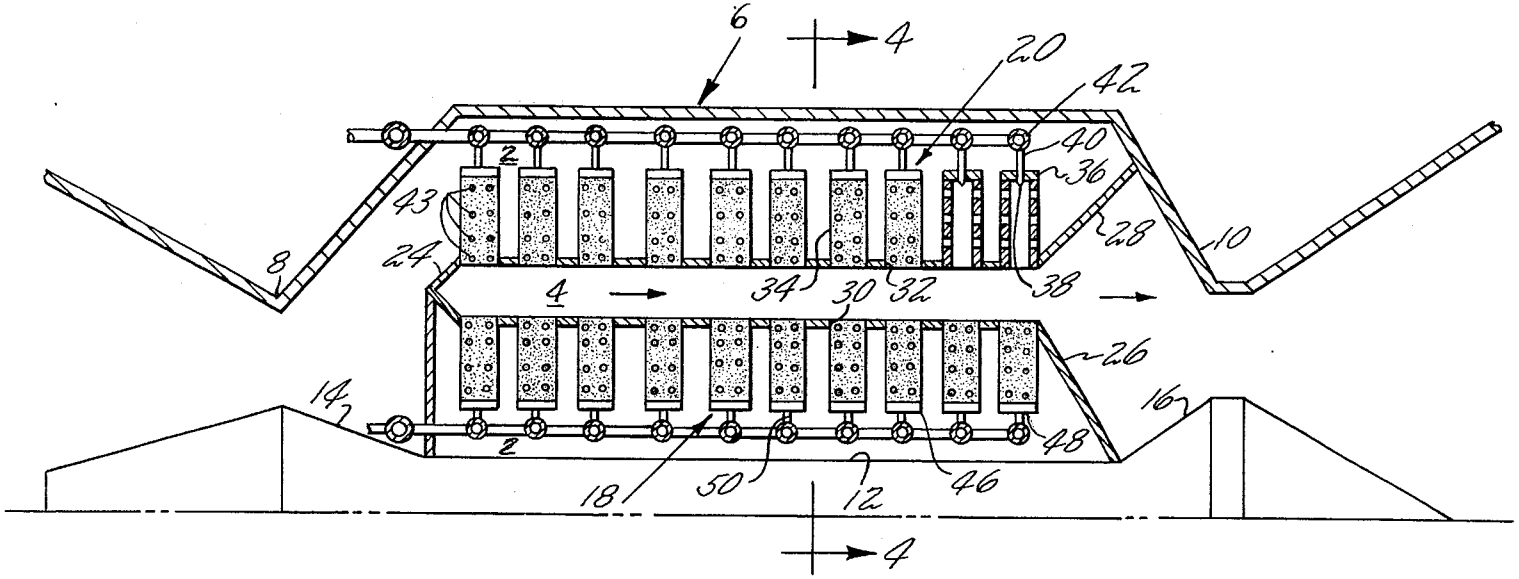
FIG. 1 is a longitudinal sectional view through the burner construction.

As shown in FIGS. 1, 2, and 3, the burner construction is shown for use in a gas turbine engine in which a compressor, not shown, delivers air under pressure to the burner inlet 2 and the products of combustion from the burner discharge through an outlet 4 to a turbine, also not shown. The burner construction includes an outer wall 6 generally cylindrical except for the divergent inlet portion 8 at the upstream end and a convergent portion 10 at the outlet end.

The inner wall 12 of the burner construction is spaced radially inward from the outer wall to define the annular combustion chamber, and this inner wall has a central portion that is parallel to and concentric to the cylindrical portion of the outer wall. At the upstream end the inner wall has a divergent portion 14 and at the downsteam end a convergent portion 16 connecting to the outlet.

Within the combustion chamber, between the substantially cylindrical portions of the inner and outer walls, are substantially cylindrical inner and outer flame tubes 18 and 20 that are spaced apart from and parallel to one another. These tubes are spaced from the inner and outer walls 12 and 6 of the burner construction. The upstream end of the space between the tubes is closed by a cap 24 and the downstream end is open for the discharge of products of combustion to the outlet. The inner flame tube is connected at its lower end to the inner burner wall by a frusto conical closure 26 and the outer flame tube at its lower end is connected by a frusto conical closure 28 to the outer burner wall.

Both flame tubes have a plurality of rows of holes 30 and 32, the rows extending around the tubes as shown. Mounted on each of the holes 32 in the outer tube 20 is a small burner can 34 made of ceramic fiber material that is porous. One example of this material is a felt sold as "Fiberfrax," available from Carborundum. This material is in sheet form and may be rolled to form the individual can 34, either in a single thickness or in a few layers, depending on the strength required to resist the pressure drop across the wall of the can. The several cans 34 extend outward from the flame tube in a radial direction, substantially at right angles to the tube and the outer ends are spaced from the outer burner wall 6. This outer end is partially closed by a cover 36 having a central opening 38 to receive a fuel nozzle 40 therein. Supply conduits 42 for fuel to the several nozzles may all be connected to a single source if desired. The walls of the burner cans in addition to being porous have rows of openings 43 therein for the admisssion of air to mix with the fuel and support combustion within the can. The porosity of the can wall admits a small amount of air for transpiration cooling of the walls of the can. Combustion is practically complete as the products of combustion are discharged into the space between the flame tubes.

Similarly the inner flame tube 18 has a plurality of burner cans 44 mounted thereon. One end of each can is attached at the edges of the associated opening 30 in the tube and the cans extend radially inward toward the inner burner wall 12, terminating in spaced relation thereto. The inner end of each can has a closure 46 with a central opening 48 to receive a fuel nozzle 50 with a fuel supply conduit 52. The cans 44 are arranged in the same way as the cans 34 and are made of the same type of material. Holes 54 in the walls of the cans admit air for combustion and the porous walls admit small amounts of air for transpiration cooling of the can walls.

The rows of burner cans are closely spaced axially and the cans are closely spaced radially as shown in FIG. 4. Obviously, the outer flame tube will support more cans without adjacent cans being in contact and without reducing the structural integrity of the flame tubes excessively. The ceramic construction described is inexpensive compared to the sophisticated metallic flame tubes now in use and the fibrous ceramic material has been found capable of withstanding both thermal and mechanical shock so that durability and long life for this type of burner is possible. Moreover, the small diameter of the cans provides adequate strength without undesirable thickness for the cans.

The ceramic fibrous material is readily secured to form the can and to hold the can cover in position by a fiber cement adhesive, one form of which is known as Fiberfrax coating cement, made by Carborundum. This will also secure the can to the metallic flame tube. It may be desirable to position a metallic sponge spacer between the can and the flame tube to compensate for different rates of thermal expansion as will be understood.

In operation air from the compressor enters the combustion chamber externally of the burner cans and the flame tubes and passes through the burner cans where combustion takes place. With proper dimensioning substantially all combustion is completed within the ceramic cans so that the flame tubes are not exposed directly to the heat of the flame and may thus be metallic without being damaged by the heat.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the U.S. is:

1. A burner construction including:

a substantially cylindrical surrounding outer wall;

an inner wall spaced from and enclosed by said outer wall, said inner wall having a plurality of holes therein; and a plurality of individual burner cans mounted on said inner wall, each burner can having a perforate sidewall and having a fuel nozzle opening at one end, and having the other end attached to one of the openings in the inner wall with the axis of each individual burner extending substantially at right angles to the inner wall, said burners being totally within the cylindrical outer wall.

2. A burner as in claim 1 in which the individual burner cans are porous ceramic material.

3. A burner as in claim 1 in which the individual burner cans are made of porous ceramic and the inner wall is metallic.

4. A burner as in claim 2 in which each of the burner cans has a plurality of rows of holes in the side walls.

5. A burner as in claim 2 in which the burner cans are substantially cylindrical and are made of ceramic fibers.

6. A burner construction including:

an outer substantially cylindrical wall;

an inner substantially cylindrical wall spaced radially inwardly of the outer wall and defining between said inner and outer walls an annular combustion chamber;

inner and outer flame tubes spaced apart and positioned between the inner and outer walls in spaced relation thereto, at least one of said tubes having a plurality of holes therein; and a plurality of individual burner cans mounted in said openings, each burner can having one end open and secured to one of the openings in said one of said tubes, the opposite end of the can having a nozzle receiving opening therein.

7. A burner as in claim 6 in which the cans extend substantially at right angles to the tube and project toward the adjacent wall, the nozzle end of the can being spaced from said adjacent wall.

8. A burner as in claim 7 in which both tubes have openings, a plurality of cans are secured to both tubes, those on the outer tube extending substantially radially outward toward the outer wall, and those in the inner tube extending radially inward toward the inner wall.

9. A burner as in claim 6 in which the burner cans are porous ceramic.

10. A burner as in claim 8 in which the burner cans are porous ceramic.

11. A burner as in claim 6 in which the tubes are metallic and the burner cans are ceramic fiber material and are porous.

12. A burner as in claim 9 in which the walls of the burner cans have rows of holes therethrough in addition to the porosity.

* * * * *